US005471909A

United States Patent [19]

Kobelt

[11] Patent Number: 5,471,909

[45] Date of Patent: Dec. 5, 1995

[54] FLUID CYLINDER

[76] Inventor: Jacob Kobelt, 1654 Ocean Park Road, Surrey, British Columbia, Canada, 4VA 3L9

[21] Appl. No.: 280,532

[22] Filed: Jul. 26, 1994

[51] Int. Cl.[6] ..... F01B 29/00

[52] U.S. Cl. ..... 92/161; 92/164; 92/166

[58] Field of Search ..... 92/165 R, 166, 92/161, 164

[56] References Cited

U.S. PATENT DOCUMENTS

| | | | |
|---|---|---|---|
| 165,727 | 7/1875 | Gordon | 92/166 |
| 2,518,787 | 8/1950 | Huhtala | 92/164 |
| 2,744,802 | 5/1956 | Strayer | 92/166 |
| 3,185,043 | 5/1965 | Dunham | 92/164 |
| 4,185,542 | 1/1980 | York et al. | 92/166 |
| 4,431,422 | 2/1984 | Hall | 440/61 |
| 4,731,035 | 3/1988 | Wagner | 440/61 |
| 4,773,882 | 9/1988 | Rump | 440/61 |
| 4,836,812 | 6/1989 | Griffiths | 440/61 |
| 5,002,510 | 3/1991 | Rump | 440/61 |
| 5,092,801 | 3/1992 | McBeth | 440/61 |
| 5,213,527 | 5/1993 | Fetchko | 440/61 |

OTHER PUBLICATIONS

Miller, Hydraulic cylinders, May 1954, 92/161.

*Primary Examiner*—F. Daniel Lopez
*Attorney, Agent, or Firm*—Bull, Housser & Tupper

[57] ABSTRACT

A fluid cylinder, particularly for steering a marine outboard motor, has a tubular body portion, and a piston rod and a piston movable relative to the body portion. First and second end plugs engage open end portions of the body portion and at least one end plug has an opening to receive the piston rod passing therethrough. First and second end caps enclose the first and second end plugs and open end portions of the body portion respectively, and retainers, e.g. bars, cooperate with the end caps to retain the end caps on the body portion. A seal is provided in a seal groove on an outer surface of the said one end plug, and a flat washer is located adjacent the outer face of the plug and has a clearance opening to receive the piston rod passing therethrough. An inner surface of the washer engages the seal and an outer surface of the end plug, and an outer surface of the washer is engaged by the first end cap. The end cap has an integral bracket extending laterally therefrom to avoid increasing length of the cylinder, and preferably is made by die-casting for strength and manufacturing simplicity. To avoid weeping of hydraulic fluid under pressure through the commonly porous die-cast material of the end cap, the seals, the end plug and body portion isolate the end cap from exposure to fluid under pressure.

22 Claims, 3 Drawing Sheets

FLUID CYLINDER

BACKGROUND OF THE INVENTION

The invention relates to a fluid actuated cylinder, particularly a hydraulic steering cylinder used to steer an outboard motor in a marine application.

Outboard motors are a common form of propulsion for many marine vessels, and while direct mechanical steering is practical for low power units, hydraulic steering is necessary for powerful units. Commonly, hydraulic steering is effected by a hydraulic cylinder mounted generally transversely of a longitudinal axis of the vessel, the cylinder cooperating with a tiller arm which controls steering of the outboard motor. While several different arrangements of the cylinder are possible, in one particular arrangement a balanced piston rod of the cylinder is secured at opposite ends thereof so as to be mounted transversely of the vessel in a fixed orientation, and the cylinder body moves with respect to the rod in response to fluid signals. A bracket extends from the cylinder body, and a link or coupling cooperates with the bracket and the tiller arm to effect steering as the cylinder body moves with respect to the piston rod. A variety of hydraulic steering assemblies for outboard motors is shown in U.S. Pat. No. 4,431,422 (Hall); 4,731,035 (Wagner); 4,773,882 (Rump); 4,836,812 (Griffiths); 5,002,510 (Rump); and 5,092,801 (McBeth).

In some applications the link is hinged to the bracket and disposed generally parallel or at a shallow angle to the piston rod, and within a plane disposed parallel to a plane containing the piston rod, but displaced laterally therefrom. In some of these arrangements, the bracket is bolted to the cylinder body, commonly using pinch bolts or other pressure clamping arrangements which can distort the cylinder, preventing smooth operation of the cylinder. In some pressure clamping arrangements, the bracket is retained on the cylinder by clamping pressure alone, i.e. without a positive mechanical stop, and thus relies essentially on friction to hold the bracket in place. If the bracket inadvertently moves with respect to the cylinder body, additional clamping pressure is required, which can aggravate distortion of the cylinder.

To avoid clamping the bracket to the cylinder body to eliminate distortion of the body, and yet to provide sufficient rigidity, the bracket can be attached to an end cap of the cylinder to project axially from the cylinder. However, this increases overall length of the cylinder which can increase installation difficulties. Also, to avoid use of separate brackets, end caps of the cylinders have been provided with integral brackets, but this can be costly if the cylinder end caps and brackets are machined from stock material.

SUMMARY OF THE INVENTION

The invention reduces the difficulties and disadvantages of the prior art by providing an end fitting or end cap for a hydraulic cylinder in which the bracket is integral with the end cap and projects transversely outwardly therefrom. Thus, the bracket does not project axially beyond the end of the cylinder, and therefore does not increase overall length of the cylinder thus facilitating installation. In addition, to eliminate or reduce machining costs, the bracket is die-cast which provides a relatively low cost integral or unitised end cap and bracket which is characterised by high strength and compactness. Commonly, materials that have been die-cast are slightly porous to pressurized hydraulic fluid, and thus normally a die cast cylinder end cap would tend to "weep" hydraulic fluid, which is unsightly, wasteful of fluid and can be hazardous. In the present invention, to eliminate any prior art fluid "weeping" problems that would otherwise occur, the end cap is isolated from pressurized hydraulic fluid by structure within the cylinder.

A fluid cylinder apparatus according to the invention comprises a tubular body portion, a piston and piston rod, first and second end plugs, first and second end caps and retainers cooperating with the end caps. The tubular body portion has an axial bore and first and second open end portions, and the piston rod and piston are movable relative to the bore of the body portion. The first and second end plugs sealingly engage the first and second end portions respectively of the body portion and are made of non-porous material. The first end plug has a piston rod opening therein to receive the piston rod passing therethrough, the rod opening being sealed against the piston rod to prevent fluid leaking therefrom. The first and second end caps enclose the first and second end plugs and the open end portions of the body portion respectively. The first end cap has an axial clearance opening aligned with the piston rod opening of the first end plug to receive the piston rod passing therethrough. The retainers cooperate with the end caps to retain the end caps on the body portion.

Preferably, the retainers comprise each end cap having at least one pair of bar openings, the bar openings of each end cap being disposed on generally opposite sides of said end cap. The bar openings of the first end cap are aligned with corresponding bar openings of the second end cap. The retainers also comprise at least one pair of axially disposed retaining bars disposed parallel to the tubular body portion. Each bar has respective first and second end portions passing through the aligned bar openings of the first and second end caps respectively to retain the caps on the end portions of the tubular body portion. Preferably, each cap has bar embracers to embrace portions of the bars on opposite sides of the tubular body portion so that a particular portion of each bar passes closely between the end cap and the body portion and each bar embracer is aligned with a respective bar opening at each end cap. A bracket extends from one bar embracer laterally of the end cap and the axial bore, with negligible axial extension beyond an outer end wall portion of the end cap so as not to increase overall length of the cylinder apparatus.

A detailed disclosure following, related to drawings, describes a preferred embodiment of the invention which is capable of expression in structure other than that particularly described and illustrated.

DETAILED DESCRIPTION

Figure 1:
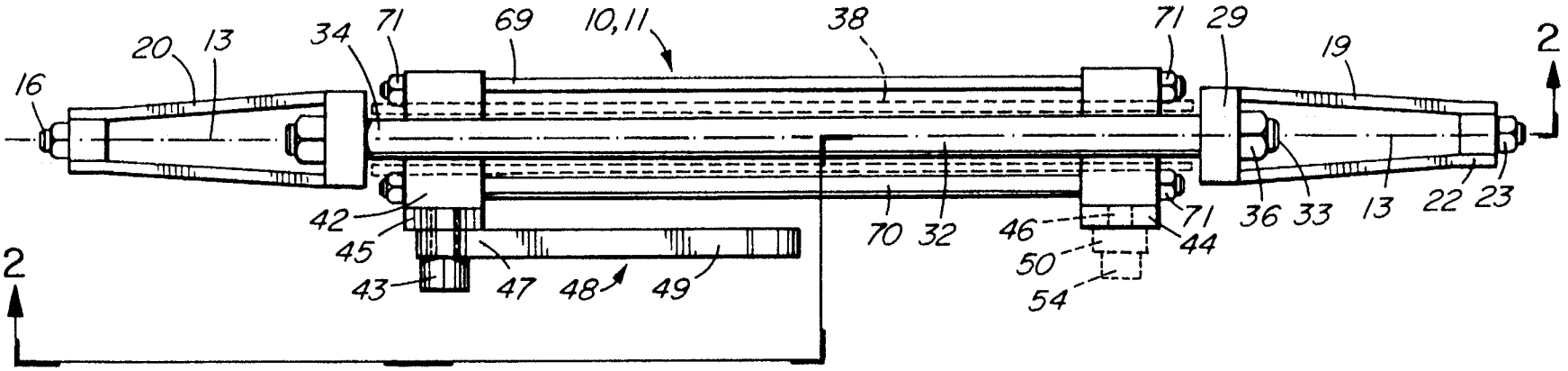
FIG. 1 is a simplified fragmented side elevation of a fluid cylinder according to the invention with associated connections for actuation of a tiller arm associated with a marine vessel.
Figure 2:
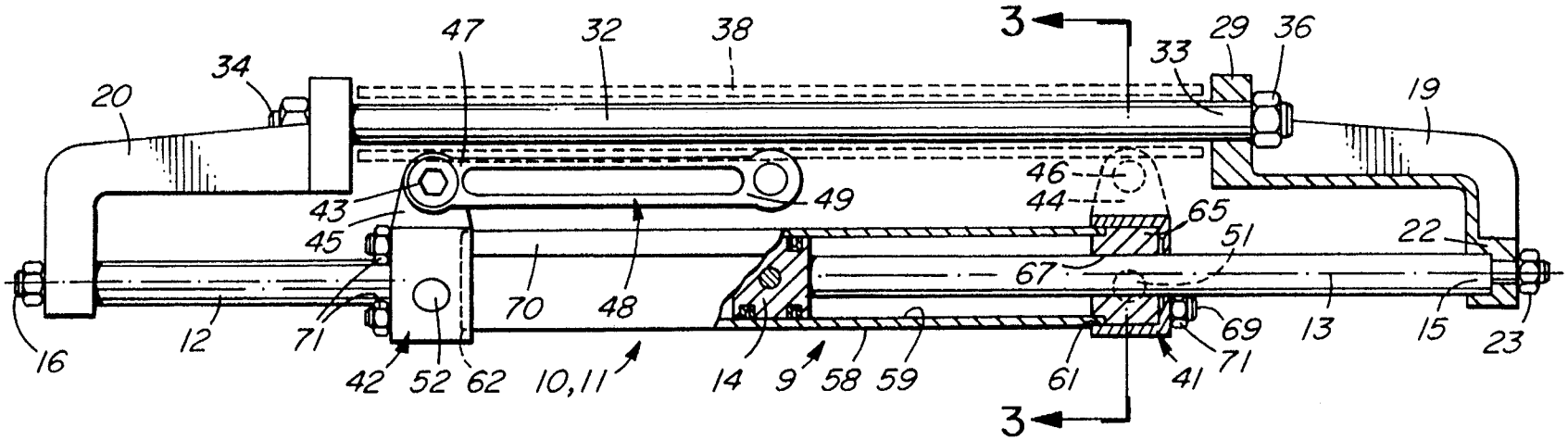
FIG. 2 is a simplified fragmented section and bottom plan as seen on line 2—2 of FIG. 1, showing some internal detail of the cylinder and connections to the tiller arm.

FIGS. 1 and 2

A fluid cylinder apparatus 10 according to the invention is a portion of a hydraulic steering apparatus 11 which is commonly supplied with hydraulic fluid which is pressurised by a hand-actuated helm pump rotated by a steering wheel. The apparatus 10 has a cylinder body 9 which is mounted for axial movement along a piston rod 12 having a longitudinal rod axis 13. The piston rod has a piston 14 secured thereto and is mounted for relative axial movement with respect to the body 12, and the rod has first and second ends 15 and 16 secured to generally similar Z-shaped first and second end connectors 19 and 20. The piston rod has a constant cross-sectional area and extends through opposite ends of the cylinder body and thus is a balanced piston rod which provides equal movements in opposite directions for the same volume of fluid displaced during actuation. The end connector 19 has an outer end portion 22 with an opening to receive the end 15 of the piston rod passed therethrough and secured thereto with a nut 23. The end connector 19 has a U-shaped cross-section and extends to an inner end portion 29 having an opening. A connecting rod 32 is disposed parallel to the piston rod 12, and is shorter than the piston rod and disposed symmetrically thereto between the end connectors 19 and 20. The rod 32 has first and second ends 33 and 34, the end 33 passing through the opening in the end portion 29 to be connected to the connector 19 by a nut 36, so that the ends 15 and 33 are connected rigidly together by the connector 19. The second end connector 20 similarly connects together the second end 16 of the piston rod to the second end 34 of the connecting rod 32. The rod 32 is journalled for rotation within a tilt tube 38, shown in broken outline, which in turn is secured to a structure adjacent the stern of a vessel, not shown, to extend transversely of the vessel.

The above resembles a common hydraulic steering apparatus which is used to control steering of an outboard motor mounted adjacent the stern of a vessel. Relative lengths of the rods 12 and 32 are dependent on the specific installation, and the rod 32 has a size determined by the tilt tube 38, which in turn determines size of the end connectors 19 and 20. Further description is unnecessary as this is common practice in the art.

The fluid cylinder apparatus 10 has first and second end caps 41 and 42 respectively, the end caps being mirror images of each other and enclosing open ends of the body 9 of the fluid cylinder. The second end cap 42 has a second bracket 45 which is connected with a screw 43 to an inner end 47 of a connecting link 48. The connecting link 48 has an outer end 49 which is connected to a tiller arm for swinging the rudder as is well known, the tiller arm not being shown. The end cap 41 has a similar first bracket 44 (shown in phantom outline in FIG. 2) which has an opening 46 to receive a screw 54 to journal a connecting link 50, a portion of which is shown in broken outline in FIG. 1. The bracket 44 is necessary if the apparatus is used in a twin motor embodiment to be described, or if the link 48 is to be alternatively connected to the bracket 44 instead of the bracket 45 for actuation of the tiller arm. Clearly, for manufacturing and installation convenience, the fluid cylinder apparatus 10 is normally supplied with both brackets 44 and 45, and the particular bracket selected depends on a particular installation. The end caps 41 and 42 have first and second fluid ports 51 and 52 respectively which are connected with flexible hydraulic hoses (not shown) to the helm pump (not shown) to receive fluid under pressure, and to discharge depressurized fluid as is well known. Supply and discharge of fluid relative to the cylinder apparatus 10 moves the cylinder axially along the piston rod 12 and swings the tiller arm as is well known.

Referring specifically to FIG. 2, the cylinder body 9 of the cylinder apparatus 10 has a tubular body portion 58 having an axial bore 59 and similar first and second open end portions 61 and 62, the end portion 62 being shown in broken outline. The apparatus 10 further includes first and second end plugs, the first plug 65 only being shown, the second end plug being generally similar but a mirror image thereof. The plugs sealingly engage the first and second open end portions 61 and 62 of the body portion respectively as will be described. The end plug 65 has a piston rod opening 67 which is a close sliding and sealing fit to receive the piston rod 12 passing therethrough. The first and second end caps 41 and 42 have axial clearance openings aligned with the piston rod openings of the end plugs to receive the piston rod passing therethrough, as will be described with reference to FIGS. 3 and 4. The end caps are also mirror images of each other, and enclose the first and second end plugs and the open end portions of the body portion respectively. A pair of axially disposed retaining bars, namely first and second retaining bars 69 and 71, are disposed parallel to the cylinder body 9 and extend through and between the first and second end caps 41 and 42. The bars have threaded ends to accept retaining nuts 71 which retain the end caps in position on the bars so as to hold the apparatus 10 together.

Figure 3:
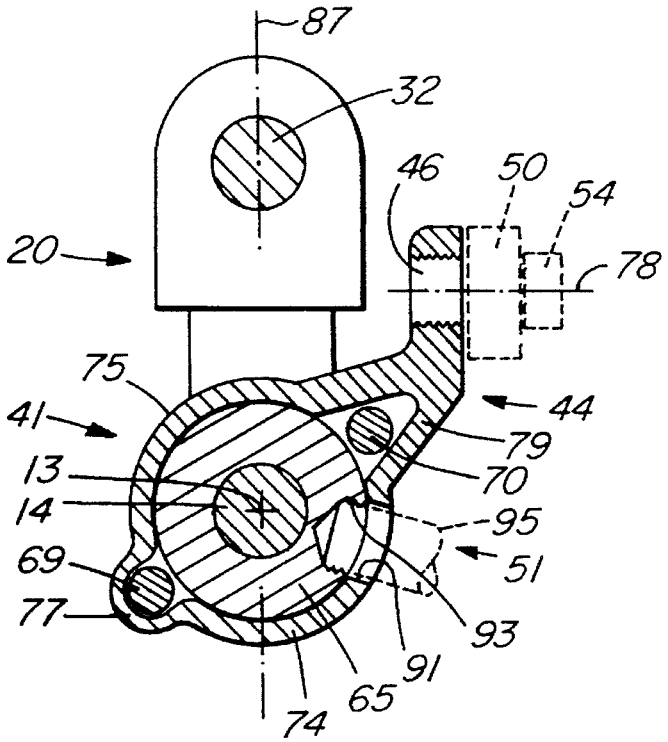
FIG. 3 is a simplified fragmented section on line 3—3 of FIG. 2.
Figure 4:
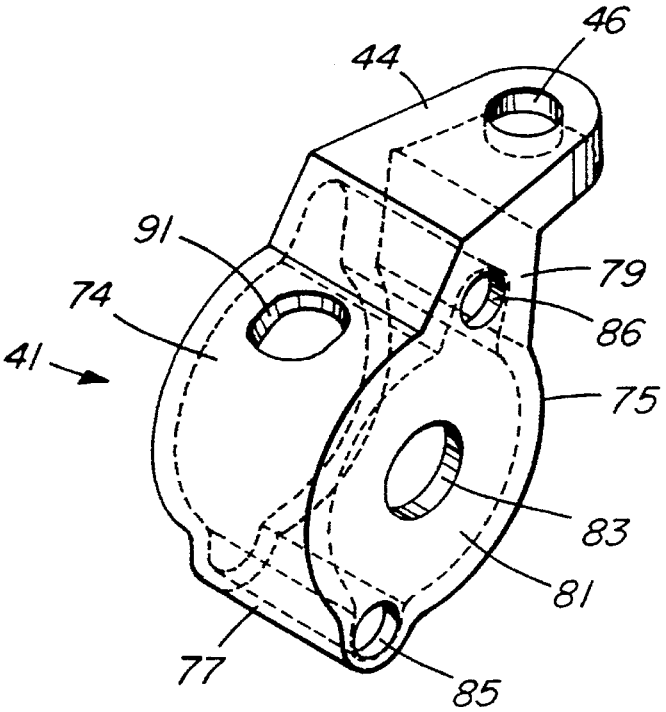
FIG. 4 is a simplified perspective of an end cap according to the invention.

FIGS. 3 and 4

The end cap 41 resembles an open-ended cup and has diametrically opposed, first and second arcuate wall portions 74 and 75 which are interconnected by a semi-cylindrical wall portion 77 and a V-sectioned wall portion 79 to form a continuous periphery to enclose the body portion. The portion 79 extends generally symmetrically and radially outwardly and is located diametrically oppositely to the semi-cylindrical wall portion 77. The end cap 41 has an end wall portion 81 which seals co-planar outer edges of the wall portions 74, 75, 77 and 79, but has an axial clearance opening 83 which is aligned with the opening 67 of the end plug to receive the piston rod 12 passing therethrough. The end wall portion 81 also has a pair of diametrically oppositely located bar openings 85 and 86 adjacent the wall portions 77 and 79 respectively to receive ends of the first and second retaining bars 69 and 70 respectively passing therethrough, as best seen in FIG. 3. The bracket 44 extends from the V-sectioned wall portion 79 parallel to a plane 87 containing the axes of the rods 12 and 32, which plane is disposed generally tangentially to a circle of appropriate diameter centred on the piston rod axis 13. The connecting link 50 is thus spaced laterally sufficiently from the end cap 41 to clear the end cap as the link 50 swings about an axis 78 passing through the opening 46 in the bracket 44 and the screw 54, as best seen in FIG. 3.

While the bracket 44 is shown to extend non-radially relative to the body portion 58, clearly in other applications the bracket could extend radially, with suitable arrangements to provide clearance as needed. In addition, while the bracket is shown extending from V-sectioned wall portion 79, it could extend from other portions of the end cap. However, to obtain some benefits of the invention, outer edges of the brackets 44 and 45 are contained within an envelope of parallel planes, not shown, which are co-planar with outer end portions of the end caps 41 and 42. Thus, the bracket 44, for example, extends only laterally of the end cap 41 and laterally of the axial bore 59 of the body portion, with negligible extension beyond the outer end wall portion 81 of the end cap so as not to increase overall length of the cylinder apparatus. This contrasts with some hydraulic cylinders of the prior art, wherein the bracket is secured to extend axially from an end face of the end of the cylinder and thus increases overall length of the cylinder, which increases installation difficulties.

It can be seen in FIG. 4 that the end cap 41 is a relatively compact and sturdy one-piece item, and that the wall portions 77 and 79 closely enclose or embrace the retaining bars 69 and 70 respectively, which bars cooperate with the respective wall portions and the end plug to provide relatively long axial contact between the end cap, the end plug and the retaining bars. In this way, the close contact and relatively long axial contact between the wall portions of the end cap, the end plug and the retaining bars assist in resisting any twisting tendency imposed on the bracket 45 by oblique forces from the link 48. Also, the arcuate wall portions 74 and 75 closely enclose the end plug to further increase rigidity of connections between adjacent components. In addition, the wall portions 77 and 79 hold the retainer bars closely adjacent the side walls of the body portion 58, thus reducing the space required for installation and providing a compact and rigid unit. In contrast to prior art structures, the bracket 45 and the associated end cap are integral with each other, and are securely retained by the retaining bars, thus essentially preventing inadvertent displacement between the bracket and the tubular body portion 58 that can otherwise occur in prior art structures in which the bracket is secured by other means to the cylinder body.

In summary, the retaining bars secure the end caps and integral brackets adjacent to the ends of the cylinder body and the end plugs by applying an axial compressive force, and also stiffen the connections of the brackets to the body portion to resist any relative movement between a particular bracket and the cylinder due to oblique forces. The wall portions 77 and 79 thus serve as bar embracers to embrace adjacent portions of the bars on opposite sides of the cylinder body so that a particular portion of each bar passes closely between the end cap and the body portion 58. Clearly, the bar embracers of each end cap are aligned axially with respect to the respective bar openings. The V-sectioned wall portion 79 provides a sturdy base for the bracket 44 and opposing inner faces of the V-sectioned wall portion engage the bar 70 which assists in securely locating the V-sectioned wall portion and therefore the end cap with respect to the cylinder. Thus, any tendency of the end cap to twist with respect to the body portion or the end plug 65 is strongly resisted by the retaining bars, as well as by inner faces of the arcuate wall portions 74 and 75. This contrasts with prior art brackets which are commonly bolted to end caps of cylinders, which increases overall length of the unit which increases difficulty of installation. It also contrasts with the prior art practise of clamping brackets to body portions of cylinders in which the bracket relies on friction to locate it in a desired location, and if there is any slippage between the bracket and the cylinder, the clamps are tightened, which can result in distortion of the cylinder, detracting from cylinder performance.

In summary, it can be seen that each end cap has at least one pair of bar openings 85 and 86, the bar openings being disposed on generally diametrically opposite sides of the end cap. Also, the end caps are arranged so that the openings of the first end cap are aligned with corresponding openings of the second end cap. The pair of axially disposed retaining bars 69 and 70 are disposed parallel to the cylindrical body portion and have respective end portions passing through the aligned bar openings of the end caps to receive fasteners to retain the caps on the end portions. Thus, the bar openings, bars and nuts serve as retainers cooperating with the end caps to retain the end caps on the body portion.

For manufacturing convenience, the end caps 41 and 42 are die-cast using a suitably corrosion resistant and strong material, e.g. phosphor bronze. While such material has excellent corrosion resistance and die-casting qualities, some die-castings are commonly slightly porous to hydraulic fluid under pressure, especially where the castings have been machined to remove the casting "skin". Porosity causes the castings to "weep" the fluid, which is unsatisfactory for most applications. The present invention provides a structure which isolates the die-cast material of the end cap from hydraulic fluid under pressure by interposing a non-porous material between the pressurized fluid and the end cap. This is attained by use of the end plug 65, the body portion 58 and suitable seals as will be described. Because the body portion 58 and the end plugs are exposed to hydraulic fluid, they are made of non-porous material which is formed or machined from solid stock material so as not to "weep" hydraulic fluid when under pressure. In addition, it is noted that the end cap is of simple design for die casting that requires negligible machining after casting, thus further reducing tooling costs and unit costs.

Also, as seen in FIG. 3, the first fluid port 51 comprises a transverse clearance opening 91 in the arcuate wall portion 74 of the end cap 41, and a threaded radial opening 93 in the end plug 65. The two openings are aligned so that a threaded fluid coupling 95, shown in broken outline, can pass through the opening 91 and engage threads in the opening 93 so as to supply fluid to the end plug 65 through the flexible hoses, not shown. Thus, the end cap associated with a particular end plug has the transverse opening 91 passing therethrough, which is aligned with the radial opening 93 of the respective end plug to communicate with the fluid conduit or coupling 95 to conduct fluid between the fluid conduit and the bore of the body portion as will be described with reference to FIGS. 5 through 7.

Figure 5:
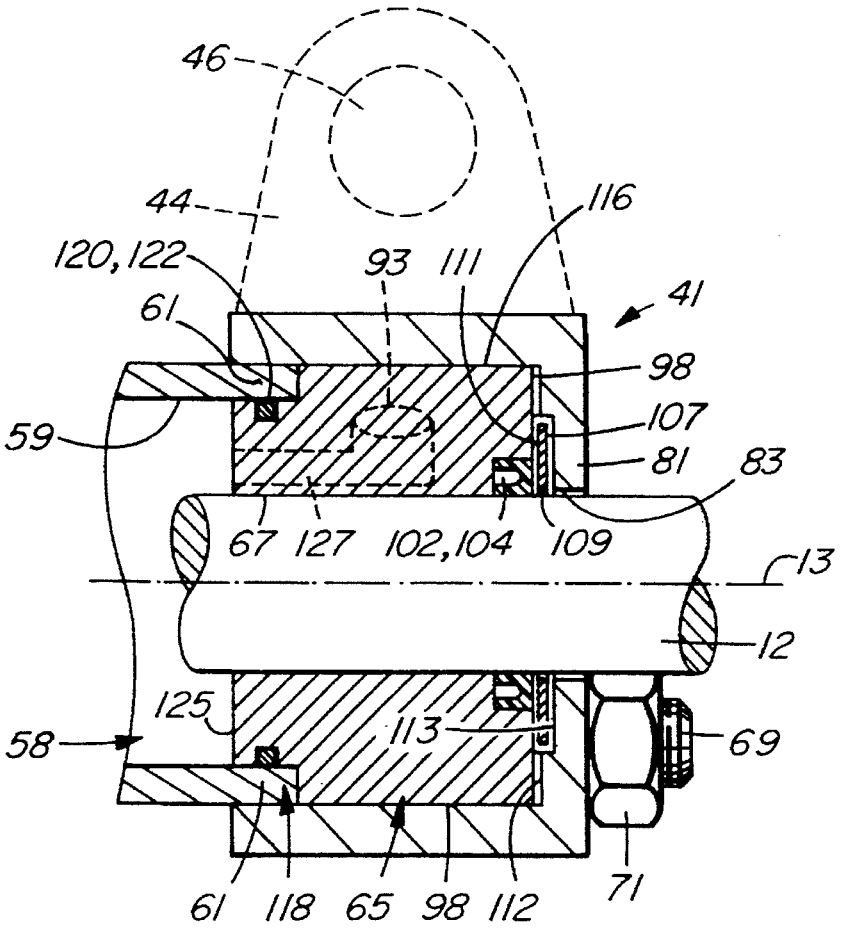
FIG. 5 is a simplified fragmented section similar to FIG. 2, but at an enlarged scale, showing structure associated with an end portion of the fluid cylinder.
Figure 6:
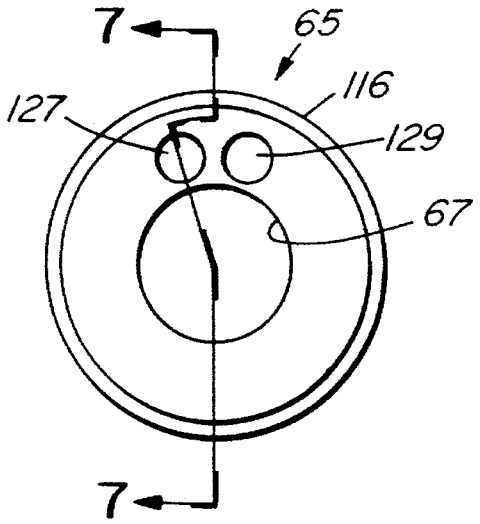
FIG. 6 is a simplified end view of an end plug associated with the invention.
Figure 7:
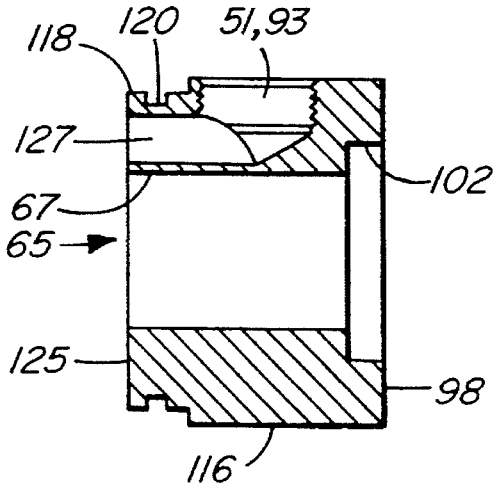
FIG. 7 is a simplified section on line 7—7 of FIG. 6 showing internal passages of the end plug.

FIGS. 5, 6 and 7

The first end plug 65 has an annular, generally flat outer surface 98 disposed perpendicularly to the rod axis 13 and containing a seal groove 102 extending around the rod opening 67. An annular seal, for example a cup seal 104, is fitted in the seal groove 102 and sealably engages the rod 12 so as to prevent fluid leaking along the rod. A flat washer 107 has a relatively close fitting clearance opening 109 to receive the piston rod 12 passing therethrough, and has a flat inner surface 111 which engages the seal 104 and the outer surface 98 of the first end plug. An inner surface 112 of the end wall portion 81 of the cap 41 has a shallow annular groove 113, the groove having a diameter to receive the flat washer 107 therein. The groove 113 has a depth which is less than thickness of the washer 107 so that the washer protrudes slightly from the inner surface 112 to ensure that an outer face of the washer is urged against the seal 104 and the outer surface 98 of the end plug. This leaves a small annular shaped clearance between the surfaces 98 and 112 extending around the washer 107. Thus, the flat washer 107 is sandwiched between the groove 113 of the end cap and the outer surface 98 of the end plug by force from the retaining bars, and ensures that the cup seal 104 remains in place to provide an effective seal against the piston rod.

The end plug 65 has a cylindrical surface 116 which is a snug fit within the end cap 41. An inner portion of the surface 116 has an annular recessed portion 118, the recessed portion being of essentially the same diameter as the bore 59 of the body portion 58 to receive the first open end portion 61 of the body portion thereon. The recessed portion 118 has an annular seal groove 120 therein which receives an annular seal, for example an O-ring seal 122, the O-ring seal sealing a gap between the first open end portion 61 of the body portion 58 and the end plug. The end plug 65 has a flat, annular inner surface 125 exposed to the bore 59 of the body portion, and a first transfer conduit 127 extends inwardly from the surface 125 to communicate with the threaded radial opening 93, which in turns communicates with the first fluid port 51. As best seen in FIG. 6, a second similar transfer conduit 129 also communicates with the opening 93 and extends parallel to the first transfer conduit 127 and thus doubles capacity of the flow between the fluid coupling and the bore 59 of the body portion.

OPERATION

Operation of the apparatus 10 follows closely the operation of prior art hydraulic steering cylinders. Clearly, pressurized supply fluid is fed into one of the ports 51 or 52 from the helm pump, and depressurized fluid is returned to the helm pump from the remaining port. This fluid displacement causes axial movement of the cylinder body 9 along the rod 12 which results in axial movement of the second bracket 45 and the link 48, which simultaneously moves the tiller arm and rotates the rudder.

It can be seen that the cup seal 104 essentially prevents leakage of fluid along the piston rod 12 past the outer surface 98 of the end plug, and the O-ring seal 122 essentially prevents linkage of fluid passed the open end portion 61 of the portion 58. Thus the end cap is essentially isolated from pressurized hydraulic fluid, and thus does not weep hydraulic fluid as would otherwise occur if the die cast end cap was exposed to pressurized fluid. In summary, the invention obtains the advantage of a compact, strong integrally cast bracket and end cap assembly, without increasing length of the cylinder or incurring problems associated with weeping through porous material commonly encountered with die-cast materials.

ALTERNATIVES

The invention discloses a single cylinder actuating the tiller arm of a single outboard motor. In a single cylinder arrangement, one bracket only is required, in this instance the bracket 45 being selected, and this connects to the tiller arm through the link 48, and thus the bracket 44 is effectively redundant. Alternatively, the bracket 44 can be used with the link 48, and the bracket 45 would then be redundant, but this would require suitable reversals of fluid connections. As is well known, two outboard motors can be controlled simultaneously, or one can be operated independently while the other is raised, by using a second steering apparatus generally similar to the apparatus 11. In this twin motor arrangement, which is not illustrated, a coupling linkage extends between the bracket 44, designated as an inner bracket, and a corresponding adjacent inner bracket on the second steering apparatus. The coupling linkage includes a pair of links which have inner ends interconnected by a conventional swivel joint, which permits one outboard motor to be raised in an inoperative position, while the remaining outboard motor is immersed and powers the vessel, independently of the raised outboard motor. Clearly, in this arrangement, two brackets are required on each cylinder as shown in FIGS. 1 and 2, in which outer brackets adjacent outer ends of the cylinders are coupled by links to the appropriate tiller arms, whereas the inner brackets adjacent the inner ends of the cylinders are coupled together through links and the known coupling linkage to couple together movements of the cylinders. Clearly, in a single cylinder apparatus the bracket 44 shown in FIGS. 1 and 2 could be eliminated.

As shown, the cylinder apparatus 10 is a balanced cylinder, that is the piston rod has a constant cross-sectional area and passes through openings in both end caps and end plugs, and for a given fluid volume displacement, movement of the cylinder in either direction is equal. In alternative hydraulic steering arrangements, or other hydraulic cylinder applications, an unbalanced cylinder could be substituted, in which case a single piston rod would pass through one end cap and end plug, and ends of the remaining end cap and end plug would be closed as is well known.

What is claimed is:

1. A fluid cylinder apparatus comprising:

(a) a tubular body portion having an axial bore and first and second open end portions, (b) a piston rod and piston movable axially relative to the bore of the body portion, (c) first and second end plugs having respective cylindrical surfaces sealingly engaging the first and second open end portions respectively of the body portion to prevent fluid leaking between the first and second end portions and the respective end plugs, the end plugs being of a non-porous material to prevent seepage of pressurized fluid therethrough, the first end plug having a piston rod opening therein to receive the piston rod passing therethrough, and an annular seal cooperating with the piston rod opening and the piston rod to prevent fluid leaking between the piston rod and the first end plug, (d) first and second end caps having respective wall portions which at least partially enclose the first and second end plugs and the open end portions of the body portion respectively, the first end cap having an axial clearance opening aligned with the piston rod opening of the first end plug to receive the piston rod passing therethrough, the annular seal being interposed between the end cap and the end plug to assist in locating the annular seal, the annular seal, the end plugs and the body portion sealingly isolating the respective end caps from pressurized fluid within the body portion, and (e) retainers cooperating with the end caps to retain the end caps on the body portion.

2. An apparatus as claimed in claim 1, further characterised by:

(a) the first end plug having an outer surface containing a seal groove extending around the rod opening, and (b) an annular seal fitted in the seal groove and sealably engaging the rod.

3. An apparatus as claimed in claim 2, further characterised by:

(a) the outer surface of the first end plug being generally flat and disposed perpendicularly to an axis of the bore, the seal groove being in the said outer surface, and (b) a flat washer having a clearance opening to receive the piston rod passing therethrough, the washer having an inner surface engaging the seal and the outer surface of the first end plug, and an outer surface engaged by the first end cap.

4. An apparatus as claimed in claim 1, in which:

(a) at least one end plug has an inner face facing into the bore of the body portion, a transfer conduit communicating with the bore of the body portion, and a radial opening extending inwardly from a cylindrical surface of the end plug and communicating with the transfer conduit, and (b) one end cap of the said first and second end caps is associated with the said one end plug and has a transverse opening passing therethrough aligned with the radial opening of the said one end plug to communicate with a fluid conduit to conduct fluid between the fluid conduit and the bore of the body portion.

5. An apparatus as claimed in claim 1, in which the retainers comprise:

(a) each end cap having at least one pair of bar openings, the bar openings of each end cap being disposed on generally opposite sides of said end cap, the bar openings of the first end cap being aligned with corresponding bar openings of the second end cap, and (b) at least one pair of axially disposed retaining bars disposed parallel to the tubular body portion, each bar having respective first and second end portions passing through the aligned bar openings of the first and second end caps respectively to retain the caps on the end portions of the tubular body portion.

6. An apparatus as claimed in claim 5, in which:

(a) the end portions of the retaining bars are screw threaded, and (b) nuts cooperate with the screw threads to retain the end caps on the bars.

7. An apparatus as claimed in claim 5, in which:

(a) one end cap have a bracket extending therefrom.

8. An apparatus as claimed in claim 7, in which:

(a) the bracket extends laterally of the end cup and laterally of the axial bore, with negligible axial extension beyond an outer end wall portion of the end cap, so as not to increase overall length of the cylinder apparatus.

9. An apparatus as claimed in claim 5, in which:

(a) each end cap has bar embracers to embrace portions of the bars on opposite sides of the tubular body portion, so that a particular portion of each bar passes closely between the end cap and the body portion, and (b) each bar embracer is aligned with a respective bar opening at each end cap.

10. An apparatus as claimed in claim 9, in which:

(a) a bracket extends from one bar embracer, the bracket having an opening therein.

11. An apparatus as claimed in claim 10, in which:

(a) the bracket extends non-radially from the bar embracer.

12. An apparatus as claimed in claim 10, in which:

(a) one bar embracer has a generally V-sectioned wall which extends generally radially outwardly from the end plug, and (b) the bracket extends from an outer end of the V-sectioned wall.

13. An apparatus as claimed in claim 12, in which:

(a) the bracket extends laterally of the end cup and laterally of the axial bore, with negligible axial extension beyond an outer end wall portion of the end cap, so as not to increase overall length of the cylinder apparatus.

14. An apparatus as claimed in claim 1, in which the end cap resembles an open-ended cup and comprises:

(a) diametrically opposed, first and second arcuate wall portions, and (b) bar embracers to embrace portions of the bars on opposite sides of the tubular body portion, the bar embracers interconnecting the arcuate wall portions to form a continuous periphery to enclose the body portion.

15. An apparatus as claimed in claim 14, in which:

(a) one bar embracer comprises a semi-cylindrical wall portion, and (b) the other bar embracer comprises a V-sectioned wall portion, the V-sectioned wall portion extending generally symmetrically and radially outwardly of the semi-cylindrical wall portion.

16. An apparatus as claimed in claim 15, in which:

(a) the bracket extends from an outer end of the V-sectioned wall, and (b) the bracket extends laterally of the end cup and laterally of the axial bore, with negligible axial extension beyond an outer end wall portion of the end cap, so as not to increase overall length of the cylinder apparatus.

17. An apparatus as claimed in claim 1, in which:

(a) the second end plug has a piston rod opening therein to receive the piston rod passing therethrough, the rod opening of the second end plug being sealed against the piston rod to prevent fluid leakage therefrom.

18. An apparatus as claimed in claim 17, in which:

(a) the second end cap has an axial clearance opening aligned with the piston rod opening of the second end plug to receive the piston rod passing therethrough.

19. An apparatus as claimed in claim 1, in which:

(a) the first and second end caps are die-cast.

20. A fluid cylinder apparatus comprising:

(a) a tubular body portion having an axial bore and first and second open end portions, (b) a piston rod and piston movable axially relative to the bore of the body portion, (c) first and second end plugs sealingly engaging the first and second open end portions respectively of the body portion, the end plugs being of a non-porous material, the first end plug having a piston rod opening therein to receive the piston rod passing therethrough, the rod opening being sealed against the piston rod to prevent fluid leaking therefrom, the first end plug having an outer surface containing a seal groove extending around the rod opening, and an annular seal fitted in the seal groove and sealably engaging the rod, (d) first and second end caps enclosing the first and second end plugs and the open end portions of the body portion respectively, the first end cap having an axial clearance opening aligned with the piston rod opening of the first end plug to receive the piston rod passing therethrough, and (e) retainers cooperating with the end caps to retain the end caps on the body portion.

21. An apparatus as claimed in claim 20, further characterised by:

(a) the outer surface of the first end plug being generally flat and disposed perpendicularly to an axis of the bore, the seal groove being in the said outer surface, and (b) a flat washer having a clearance opening to receive the piston rod passing therethrough, the washer having an inner surface engaging the seal and the outer surface of the first end plug, and an outer surface engaged by the first end cap.

22. A fluid cylinder apparatus comprising:

(a) a tubular body portion having an axial bore and first and second open end portions, (b) a piston rod and piston movable axially relative to the bore of the body portion, (c) first and second end plugs sealingly engaging the first and second open end portions respectively of the body portion, the end plugs being of a non-porous material, the first end plug having a piston rod opening therein to receive the piston rod passing therethrough, the rod opening being sealed against the piston rod to prevent fluid leaking therefrom, (d) first and second end caps enclosing the first and second end plugs and the open end portions of the body portion respectively, the first end cap having an axial clearance opening aligned with the piston rod opening of the first end plug to receive the piston rod passing therethrough, and (e) retainers cooperating with the end caps to retain the end caps on the body portion, the retainers comprising each end cap having at least one pair of bar openings, the bar openings of each end cap being disposed on generally opposite sides of the said end cap, the bar openings of the first end cap being aligned with corresponding bar openings of the second end cap; and the retainers also comprising at least one pair of axially disposed retaining bars disposed parallel to the tubular body portion, each bar having respective first and second end portions passing through the aligned bar openings of the first and second end caps respectively to retain the caps on the end portions of the tubular body portion.

* * * * *